US005092002A

United States Patent [19]

Powers

[11] Patent Number: 5,092,002

[45] Date of Patent: Mar. 3, 1992

[54] METHOD AND APPARATUS FOR FORMING A SHOWER BASE

[76] Inventor: Norman C. Powers, 101 Ouscilla La., Cocoa Beach, Fla. 32931

[21] Appl. No.: 541,721

[22] Filed: Jun. 21, 1990

[51] Int. Cl.[5] ..... A47K 3/22

[52] U.S. Cl. ..... 4/596; 4/613

[58] Field of Search ..... 4/612, 613, 596; 52/177, 211

[56] References Cited

U.S. PATENT DOCUMENTS

| | | | |
|---|---|---|---|
| 2,757,385 | 8/1956 | Whittick | 4/613 |
| 3,269,076 | 8/1966 | Strand | 52/309.13 |
| 3,443,345 | 5/1969 | Spencer | 52/211 |
| 3,451,178 | 6/1969 | Beale | 4/612 X |
| 3,800,335 | 4/1974 | Buonaura | 4/613 |
| 4,423,528 | 1/1984 | Weidmeier | 4/613 |
| 4,492,062 | 1/1985 | Levenez | 52/211 X |
| 4,551,870 | 11/1985 | Presti, Jr. | 4/613 |
| 4,557,004 | 12/1985 | Piana | 4/613 |
| 4,768,320 | 9/1988 | Weller | 52/211 |
| 4,885,882 | 12/1989 | Forshee | 52/177 |
| 4,890,426 | 1/1990 | Hickman et al. | 52/60 X |
| 4,907,387 | 3/1990 | Turnbull | 52/177 |

FOREIGN PATENT DOCUMENTS 2103108 7/1972 Fed. Rep. of Germany .

*Primary Examiner*—Henry J. Recla
*Assistant Examiner*—Robert M. Fetsuga
*Attorney, Agent, or Firm*—Shlesinger, Arkwright & Garvey

[57] ABSTRACT

The present invention is directed to a shower base including a floor, a drain formed in the center thereof and a low water retaining wall extending along at least a portion of the floor of the shower base. The water retaining wall includes an inclined insert formed of polyvinyl chloride. The inclined insert includes an inner wall adapted to be positioned adjacent the floor of the shower, an outer wall removed therefrom and an upper surface extending therebetween. The upper surface forms an angle of greater than 90° with the inner wall and an angle of less than 90° with the outer wall. Accordingly, the upper surface is inclined downwardly in the direction of the floor of the shower and, therefore, water forming about the upper surface of the water retaining wall is directed to the drain formed in the floor of the shower base.

18 Claims, 1 Drawing Sheet

METHOD AND APPARATUS FOR FORMING A SHOWER BASE

FIELD OF THE INVENTION

The preferred embodiment of the present invention is directed to a shower base. More specifically, the preferred embodiment relates to a device for retaining water in a shower.

BACKGROUND OF THE INVENTION

Showers and the bases thereof have been previously configured in a variety of different manners. Generally, the bases of these structures include a floor having a drain formed in the center thereof and a low water retaining wall formed along at least a portion of the outer periphery of the floor. The water retaining wall is normally of sufficient height to prevent any standing water in the base of the shower from flowing to the immediately surrounding area, yet low enough to permit an individual to step over the same to enter the shower.

Retaining walls of this nature have been formed by stacking several wooden 2×4's one on top of the other and positioning the same on at least a portion of an outer periphery of the floor. A water resistant layer is disposed around the outer periphery of the drain and extends outwardly to cover the inner and uppermost surfaces of the 2×4's. Subsequently, the floor and the outer periphery of the water retaining wall are tiled. In this manner, the water retaining wall is formed with a rectangular cross-section. This configuration has several disadvantages, one being that water forming about the upper surface of the retaining wall is free to flow to the surrounding area. As is generally the case, the area immediately surrounding the shower is readily susceptible to water damage. With repeated use of the shower, this could lead to costly and time consuming repairs. It has not been previously possible to readily construct a water retaining wall of a shower base such that water forming about the upper surface thereof is directed to the shower base to be drained therefrom.

OBJECTS AND SUMMARY OF THE INVENTION

An object of the present invention is to provide a method and apparatus for forming a shower base free from the aforementioned disadvantages of previously known related devices.

Another object of the present invention is to provide a method and apparatus for forming a shower base with a water retaining wall configured in such a manner as to direct water forming about the upper surface thereof to a drain operably associated therewith.

Yet another object of the present invention is to provide a water retaining wall with an insert for directing water forming about the upper surface of the retaining wall positioned on an interior supporting member having a configuration different therefrom, thereby obviating the need for machining of the interior supporting member or the use of specially configured tile.

A further object of the present invention is to provide an insert that can be used in shower bases having a variety of configurations.

Still a further object of the present invention is to provide a cost effective method and apparatus for forming a water retaining wall of a shower base for inhibiting water forming about the upper surface thereof from flowing to the surrounding area of the shower.

These and other objects of the present invention will be readily apparent from the following detailed description of the preferred embodiment of the present invention.

In summary, a preferred embodiment of the present invention is directed to a shower base including a floor, a drain formed in the center thereof and a low water retaining wall extending along at least a portion of the floor of the shower base. The water retaining wall includes an inclined insert formed of polyvinyl chloride. The inclined insert includes an inner wall adapted to be positioned adjacent the floor of the shower, an outer wall removed therefrom and an upper surface extending therebetween. The upper surface forms an angle of greater than 90° with the inner wall and an angle of less than 90° with the outer wall. Accordingly, the upper surface is inclined downwardly in the direction of the floor of the shower and, therefore, water forming about the upper surface of the water retaining wall is directed to the drain formed in the floor of the shower base.

DETAILED DESCRIPTION OF THE DRAWINGS

DETAILED DESCRIPTION OF THE PRESENT INVENTION

The preferred embodiment of the present invention will hereinafter be described.

FIGS. 1 THROUGH 4

Figure 1:
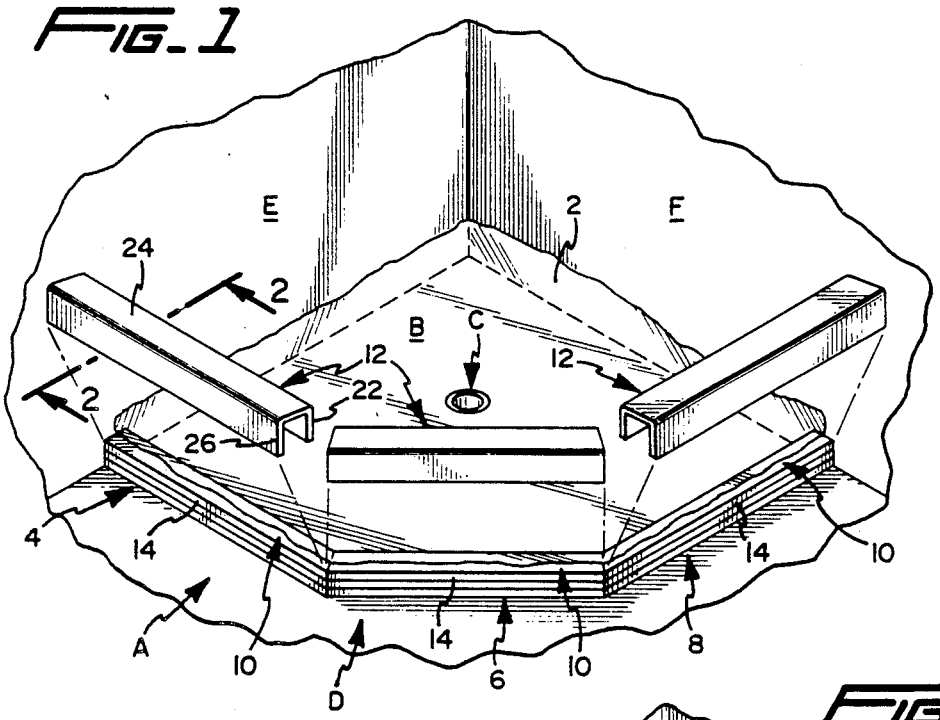
FIG. 1 is a perspective view of a shower base formed in accordance with the preferred embodiment of the present invention illustrating the inclined insert disposed above the interior supporting member.

Referring to FIG. 1, a shower base A includes a floor B, a drain C formed in the center of floor B, a retaining wall D extending along a portion of the outer periphery of floor B and side walls E and F bounding the remaining portion of the outer periphery of floor B. The floor B includes a water resistant liner 2 which extends outwardly from the outer periphery of drain 0 to the water retaining wall D and side walls E and F.

Figure 4:
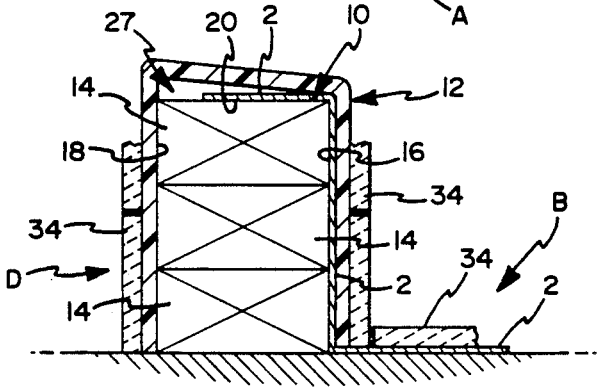
FIG. 4 is an enlarged cross-sectional view of the shower base illustrated in FIG. 3 taken along line 4—4 and further depicting several tile sections.

The water retaining wall D includes first segment 4, second segment 6, and third segment 8. Segments 4, 6 and 8 are each comprised of an interior supporting member 10 and an inclined insert 12. Referring to FIG. 4, the supporting members 10 include three wooden 2×4's 14 stacked one on top of the other thereby forming an inner surface 16 positioned adjacent floor B, an outer surface 18 removed therefrom and an upper surface 20. Upper surface 20 extends perpendicular to surfaces 16 and 18. The water resistant liner 2 overlies the inner surfaces 16 as well as the upper surfaces 20 of supporting members 10.

Figure 2:
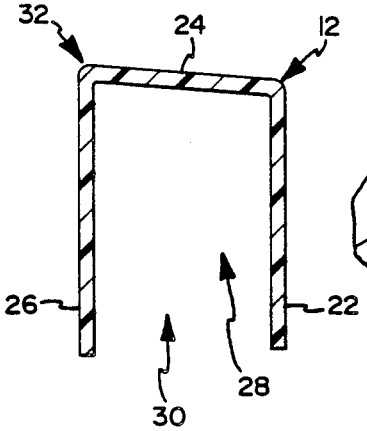
FIG. 2 is an enlarged cross-sectional view of the inclined insert of FIG. 1 taken along line 2—2.
Figure 3:
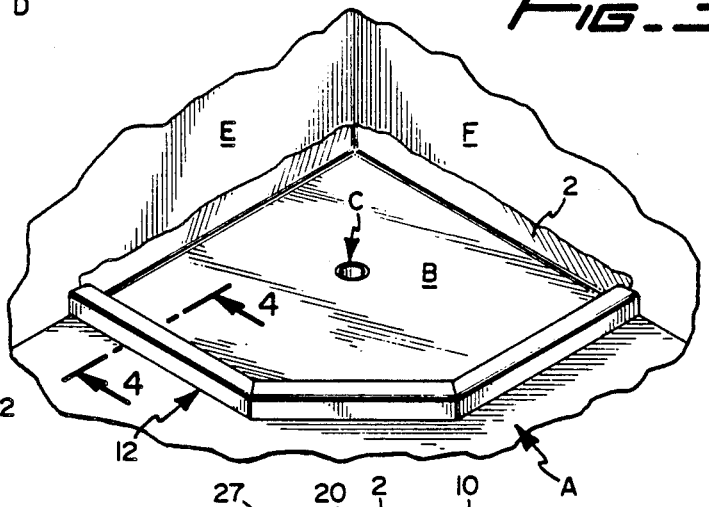
FIG. 3 is a perspective view of a shower base formed in accordance with the present invention illustrating the inclined insert positioned on the interior supporting member.

The inclined inserts 12 each include an inner wall 22, an upper wall 24 and an outer wall 26, as seen in FIG. 2. A hollow cavity 28 extends between first end 30 and second end 32. First end 30 has an opening formed therein for receiving the interior supporting members 10. The upper wall 24 forms an angle of greater than 90° with the inner wall 22. Further, the upper wall 24 forms an angle of less than 90° with outer wall 26. Accordingly, the upper wall 24 is inclined downwardly toward the inner wall 22. In the preferred embodiment, the inner wall 22 extends 4½ inches from the underside of upper wall 24 and outer wall 26 extends therefrom 4¾ inches. The upper surface 16 has a length of 4¼ inches, measured form the innermost portion of wall 22 to the outermost portion of wall 26. Walls 22, 24 and 26 have a uniform thickness of ¼ inch. Preferably, inclined insert 12 is formed from polyvinyl chloride.

METHOD FOR FORMING A SHOWER BASE CONFIGURED IN ACCORDANCE WITH THE PRESENT INVENTION

The preferred method for constructing a shower base formed in accordance with the present invention will hereinafter be described.

FIGS. 1 THROUGH 4

An appropriate location in a residence, office building or the like is selected for installing a shower. For example, a corner of a room may be selected for positioning the shower, as shown in FIG. 1. However, it will be readily appreciated that the shower may be located in other areas of the room and is not limited to corners thereof. A drain 0 is formed in the center of that area designated as the shower base. A conventional water resistant liner 2 is disposed such that it extends from the outer periphery of drain C and covers at least a portion of side walls E and F as well as the inner surfaces 16 and the upper surfaces 20 of the interior supporting members 10. The water resistant liner 2 prevents the floor of the foundation, side walls E and F, the inner surfaces 16 and upper surfaces 20 from experiencing water damage.

The inclined inserts 12 are cut to the dimensions of the corresponding segments 4, 6 and 8 and positioned thereon. As seen in FIG. 4, a space 27 is formed between the inclined insert 12 and first segment 4. Although not shown, similar spaces are provided between segments 6 and 8 and the corresponding inclined inserts 12. A conventional sealant is applied along the outer periphery of inclined inserts 12. The shower base A, in the preferred embodiment, is tiled with tile sections 34 along the outer periphery of the inclined inserts 12, the floor B, and at least a portion of side walls E and F. Accordingly, a tiled retaining wall D is formed with an inclined upper surface thereby directing any water forming thereabout through drain C.

It will be readily appreciated that a shower base formed in accordance with the present invention will prevent the immediately surrounding area from encountering water damage. Furthermore, this is accomplished without machining any of the segments 4, 6 and 8 or alternatively using specially configured tile. Accordingly, a shower base formed in accordance with the present invention can be readily and inexpensively constructed.

While this invention has been described as having a preferred design, it is understood that it is capable of further modifications, uses and/or adaptations of the invention, following in general the principle of the invention, and including such departures from the present disclosure as come within known or customary practice in the art in which the invention pertains, and as may be applied to the central features hereinbefore set forth, and fall within the scope of the invention of the limits of the appended claims.

I claim:

1. A base for a shower having a shower head mounted in a shower stall, said base comprising:

a) a shower stall floor having an outer periphery and operably associated with a shower drain; and b) a water retaining member extending along at least a portion of said outer periphery of said floor, said water retaining member being a separate element from said floor and having an inner wall positioned adjacent said floor, an outer wall positioned removed from said floor periphery and an intermediate wall connecting said inner wall and said outer wall and positioned above said floor, said intermediate wall forming an interior angle greater than 90° with said inner wall.

2. An apparatus as in claim 1, wherein:

a) said inner wall extends substantially parallel to said outer wall.

3. An apparatus as in claim 1 wherein:

a) said outer wall forms an interior angle less than 90° with said intermediate wall.

4. An apparatus as in claim 1, wherein:

a) said inner wall and said outer wall each include an upper portion and a lower portion, said intermediate wall includes a first end and second end, said first end of said intermediate wall abuts said upper portion of said outer wall and said second end of said intermediate wall abuts said upper portion of said inner wall.

5. A base for a shower having a shower head mounted in a shower stall and associated with a shower drain, said base comprising:

a) a shower stall floor having an outer periphery and adapted to be operably associated with the sower drain; and b) at least two separate water retaining members extending along at least a portion of said outer periphery of said floor, each said water retaining member including an inner wall positioned adjacent said floor, an outer wall removed from said floor, and an upper wall connected therebetween, said upper walls forming interior angles greater than 90° with said inner walls, said upper wall being disposed above said floor a height sufficient to prevent water pooling on the floor of the shower from flowing to an area surrounding the shower stall while permitting an individual to traverse said retaining member to gain access to the shower.

6. An apparatus as in claim 5 wherein:

a) each said upper wall and said outer wall form an interior angle of less than 90°.

7. An apparatus as in claim 6, further including:

a) an interior supporting member, said interior supporting member having an inner surface, an outer surface and an upper surface extending therebetween; and b) said each water retaining member is positioned on said interior supporting member such that a space is formed between said upper wall of said water retaining member and said upper surface of said interior supporting member.

8. An apparatus as in claim 7, wherein:

a) each said upper wall extends at an angle with respect to said upper surface of said interior supporting member.

9. An apparatus as in claim 6, wherein:

a) each said outer wall extends substantially parallel to said inner wall.

10. An apparatus as in claim 5, wherein:

a) a hollow cavity extends between a first end and a second end of each said water retaining member; and b) an opening is formed in said first end of said water retaining member.

11. A base for a shower having a shower head mounted in the shower stall and associated with a shower drain, said base comprising:

a) a shower stall floor having an outer periphery and adapted to be operably associated with the shower drain;

b) a water retaining member extending along at least a portion of said outer periphery of said floor, said water retaining member having an inner wall, an outer wall and an upper wall connecting said inner wall to said outer wall, said upper wall being disposed above said floor and forming an interior angle greater than 90° with said inner wall, said retaining member being a separate element from said floor; and, c) an interior supporting member, said water retaining member being positioned on said interior supporting member such that a space is formed between said upper wall and an upper surface of said interior supporting member.

12. An apparatus as in claim 11, wherein:

a) a plurality of tiled sections are formed on said water retaining member.

13. A method for forming a base for a shower having a shower head mounted in a shower stall and associated with a shower drain, said method comprising the steps of:

a) providing a shower stall floor having an outer periphery and adapted to be operably associated with the shower drain;

b) providing at least one water retaining member being a separate element from the floor and having an inner wall, an outer wall, an upper wall connecting the inner and outer walls, and forming an interior angle greater than 90° with the inner wall, and a hollow cavity extending between the inner and outer walls;

c) positioning the retaining member to extend along at least a portion of the outer periphery of the floor.

14. A method as in claim 13, including the further steps of:

a) providing an interior supporting member having an upper surface, outer surface and inner surface; and, b) positioning the retaining member on the interior supporting member such that the interior supporting member extends into the hollow cavity of the retaining member.

15. A method as in claim 14, including the further step of:

a) forming a space between the upper wall of the retaining member and the upper surface of the interior supporting member.

16. A method as in claim 13, including the further step of:

a) forming the inner and the outer walls of the retaining member to extend parallel to each other.

17. A method as in claim 13, including the further step of:

a) forming the retaining member from polyvinyl chloride.

18. A method as in claim 13, including the further step of:

a) providing at least a second water retaining member having an inner wall interconnected to an outer wall by an upper wall, and a hollow cavity extending between the inner and outer walls; and, b) positioning the second retaining member to extend along at least a portion of the outer periphery of the floor.

* * * * *